United States Patent [19]

Focant

[11] 4,313,565

[45] Feb. 2, 1982

[54] APPARATUS FOR THE PROJECTION OF REFRACTORY AND OTHER MATERIAL PARTICULARLY FOR THE REPAIR OF THE LININGS OF METALLURGICAL PLANT

[75] Inventor: Jean Focant, Lessive, Belgium

[73] Assignees: Stephan Pasek & Cie, Societe Anonyme, Anhee; Cockerill, Societe Anonyme, Seraing, both of Belgium; a part interest

[21] Appl. No.: 26,590

[22] Filed: Apr. 4, 1979

[30] Foreign Application Priority Data

Apr. 7, 1978 [LU] Luxembourg ..... 79401

[51] Int. Cl.[3] ..... B05B 13/06

[52] U.S. Cl. ..... 239/132.3; 239/226; 239/227; 266/281

[58] Field of Search ..... 239/132.3, 164–166, 239/226, 227, 587; 266/281; 134/167 R; 172; 118/317, 323

[56] References Cited

U.S. PATENT DOCUMENTS

| | | | |
|---|---|---|---|
| 1,329,293 | 1/1920 | Clark | 266/281 |
| 3,827,633 | 8/1974 | Kouno et al. | 239/132.3 |
| 3,902,669 | 9/1975 | Keibler | 239/227 |
| 3,917,170 | 11/1975 | Marino | 239/165 X |
| 4,068,895 | 1/1978 | Reese et al. | 266/281 X |

FOREIGN PATENT DOCUMENTS 849524 4/1977 Belgium .

*Primary Examiner*—Andres Kashnikow
*Attorney, Agent, or Firm*—Yount & Tarolli

[57] ABSTRACT

Disclosed is an apparatus for the projection of refractory and other material for the relining and repair of a metallurgical plant, particularly converters. The apparatus comprises an articulated arm capable of pivoting on its base and supporting a lance carrier in which a telescopic, retractable lance is mounted. The lance carrier is articulated on an arm acting in the manner of a scissor, the movement of which is effected by two jacks.

3 Claims, 9 Drawing Figures

APPARATUS FOR THE PROJECTION OF REFRACTORY AND OTHER MATERIAL PARTICULARLY FOR THE REPAIR OF THE LININGS OF METALLURGICAL PLANT

BACKGROUND OF THE INVENTION

The present invention relates to apparatus for the projection by means of a lance of refractory and other material, particularly in metallurgic plant and specifically, in converters. This process is generally called "gunning".

The known processes for the repair or internal relining of converters consist in the application by various methods of a refractory material to the refractory base of the lining which is part worn or has deteriorated.

This is usually carried out manually without precision which leads to an enormous loss of time and material and makes it at least necessary to incline the converter and then remove the slag.

In Patents BE 849524 (Kurosaki Refractories Ltd.) and U.S. Pat. No. 3,827,633 (H. Koundo and S. Kubo) there is described a mobile apparatus in which a lance is movable in an oscillating sleeve which itself can pivot ultimately on a supporting column. The state of the art can be further illustrated by Patent Nos. DE 2 200 667 ( Donezkig), FR 1,528,137 (Demag), U.S. 3,351,289 (Demaison) and AU 422,354.

It should be noted however that most of the modern processes for maintaining converters require the slag to be retained in the converter which makes it difficult to repair certain parts of the converter, particularly those located between the discharge opening and the slag bath. The apparatuses of the prior art include just this inconvenience of not permitting easy access to all these parts without inclining the converter to such an extent that it is impossible to maintain a substantial pocket for slag in the converter.

SUMMARY OF THE INVENTION

The present invention therefore aims at providing apparatus for the relining, repair, and preventive maintenance of metallurgical plant such as converters in a simple and speedy way and obviating the difficulties of access to certain parts of the plants.

This object is achieved according to the invention with the aid of a mobile apparatus carrying an articulated arm capable of rotating about its base and supporting a lance holder on which can slide at least one retractible lance and which is characterised in that the lance-holder is articulated to a scissor like arm of which the opening is adjustable by an actuator.

The said actuator for the opening may be formed by an hydraulic jack or a purely mechanical system.

The elements of the lance are preferably designed in such a way as to include a double jacket in which is circulated a cooling fluid which is preferably water so that one can operate in the conditions of high temperature present in a converter.

The apparatus preferably comprises a complete installation providing for the projection of a mixture of solid matter with the addition of any desired quantity of water etc. and the material necessary to ensure the complete independence of the apparatus.

The lance may be designed in such a way as to be formed by a primary element (primary lance) in which can slide telescopically a secondary element (secondary lance), the said primary element itself sliding on the lance holder.

The displacement of the different elements of the lance, that is to say the movement of the secondary lance relative to the primary lance, and the movement of that relative to the lance holder is conveniently affected by an actuator through a cable or chain. Actuation by an endless screw, rack, or other mechanism is also possible.

According to one particularly advantageous embodiment of the apparatus of the invention, a cabin for the single operator ensuring the positioning of the machine and the operation of gunning itself is rigid with the lance carrier and located at one side of it in such a way that the operator is practically always located in the line of action of the lance.

The last element of the lance, that is to say the extremity which penetrates into the metallurgical plant may be fitted as desired with different nozzles according to the nature of the work and of the material to be projected and is rotatable to provide a suitable distribution of the repairing material.

The invention equally applies to the use of the apparatus of which the main features have been described for the relining and repair of metallurgical plant and particularly the interior of a converter and the discharge opening thereof.

Other characteristics and specified advantages of the apparatus in accordance with the invention will appear in the description which follows with reference to the annexed drawings illustrating by way of non-limiting example one preferred embodiment.

DESCRIPTION OF THE PREFERRED EMBODIMENT

Figure 1:
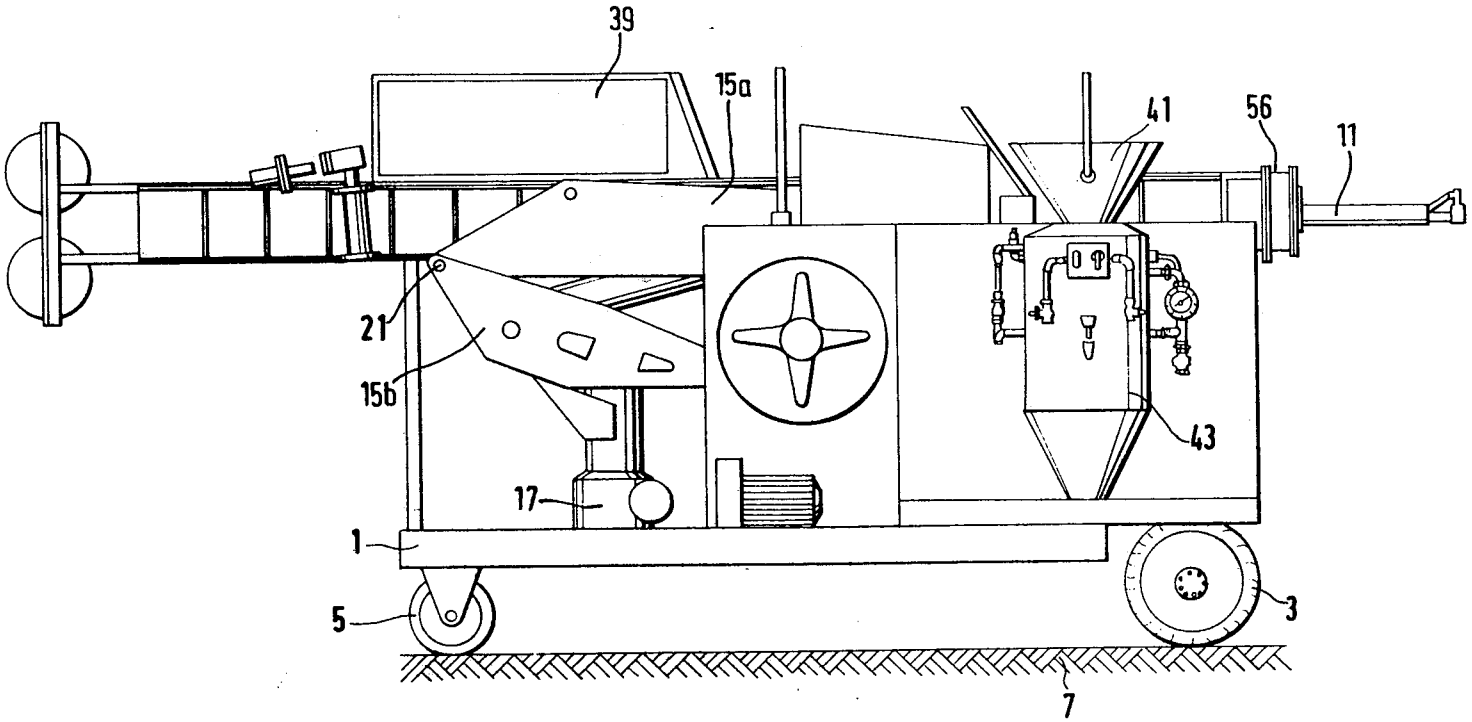
FIG. 1 is a side view (right side) arranged for travel on the working platform of converters.

In the drawings the same reference marks are used for the same elements in the different views. The terms front, rear, left and right relate to the position of the operator in his cabin when the apparatus is in the folded position.

The apparatus is formed by a chassis 1 equipped with wheels 3 at the front and a double row of rollers 5 at the back, the assembly of wheels 3 being provided with a differential and driven by a motor while the rollers 5 are orientable to ensure complete mobility of the apparatus on the platform 7 surrounding the converters.

The chassis 1 carries one part of the means for relining and repairing the converter and also the refractory material used for that purpose and the control for the relining means as well as the different driven groups.

There is shown in FIG. 1 a hopper 41 holding dry, pre-wetted or pre-coated refractory material, which is transported by pneumatic mechanism 43 towards the projection lance.

Figure 2:
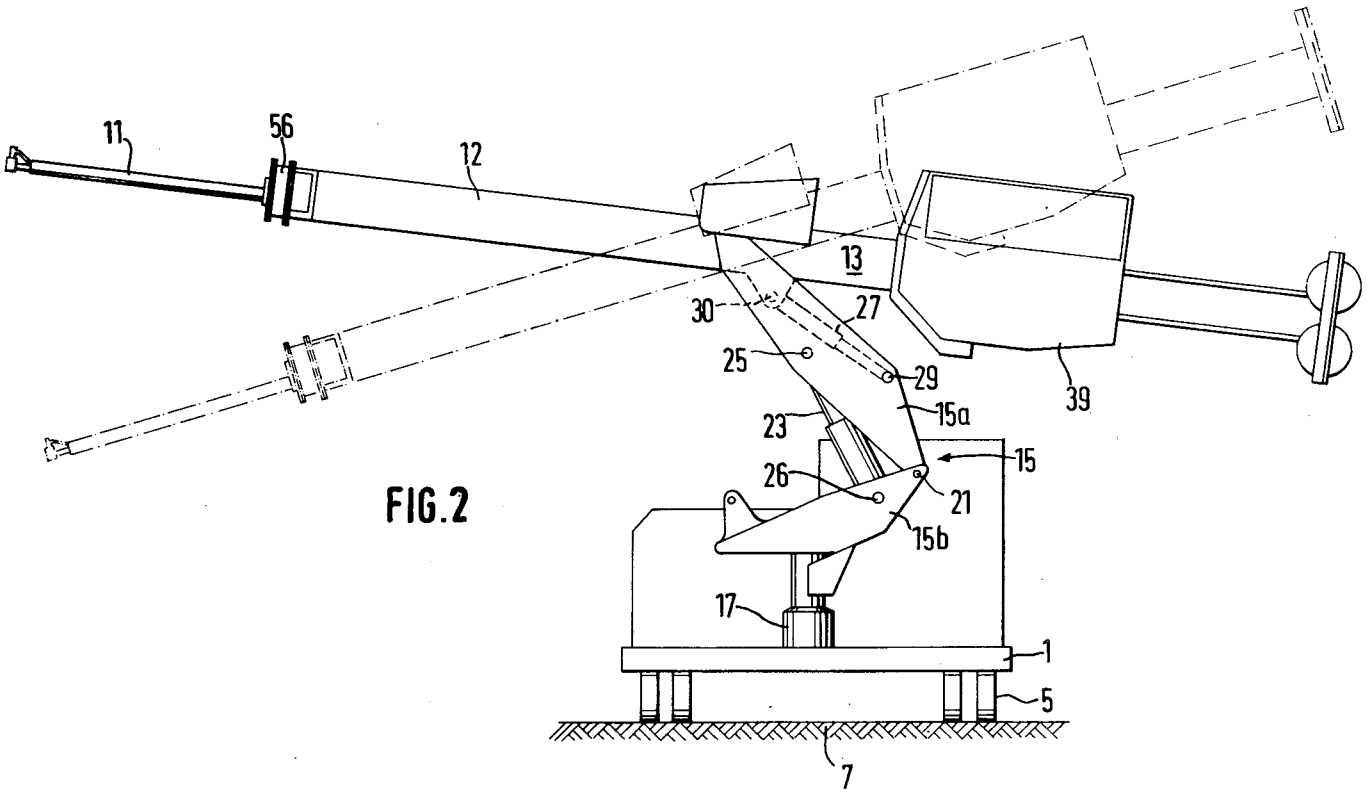
FIG. 2 is a view in a position partially opened out in which the lance carrier is set at right angles to the longitudinal axis of the supporting vehicle which is seen from the back.

The means for the relining or repairing comprises a secondary lance 4 designed for penetrating into the converter, sliding in a primary lance 12 which itself slides on a lance carrier 13 supported by an articulated scissor 15 formed by two elements 15*a* and 15*b*, this scissors 15 being itself supported by a pivoting column 17 (FIG. 2).

Figure 3:
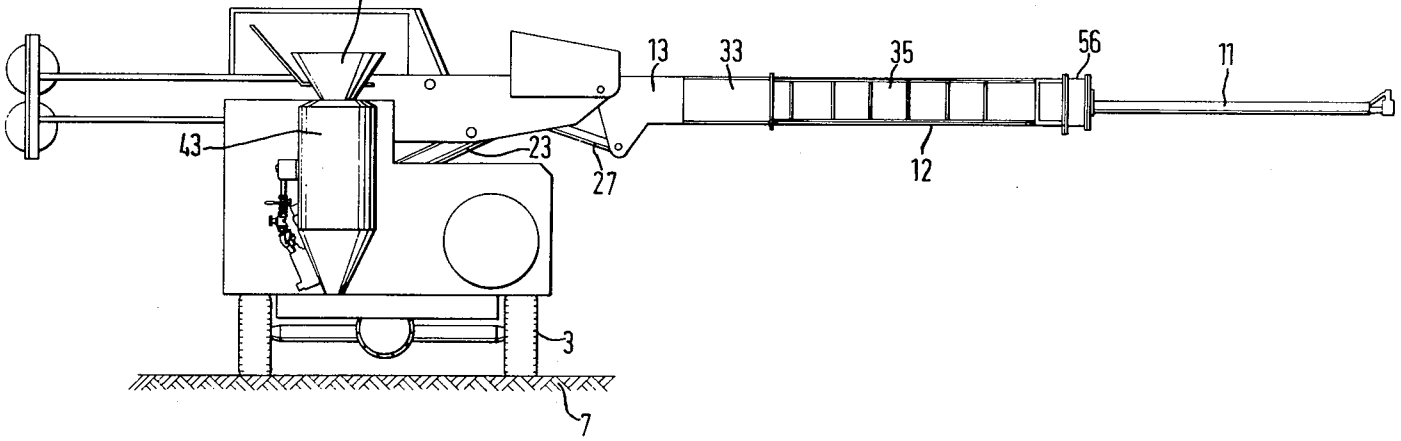
FIG. 3 is a view partially opened out and corresponding to FIG. 2, the vehicle being seen from the front.
Figure 4:
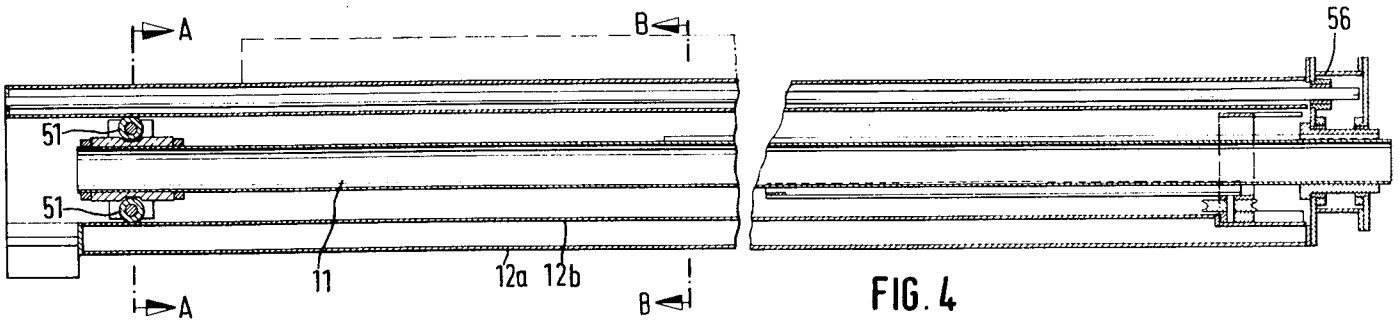
FIG. 4 is a detail view of the front part and the rear part of a lance having two elements with the secondary lance retracted into the primary lance and the middle part omitted to limit the complication of the drawing.
Figure 5:
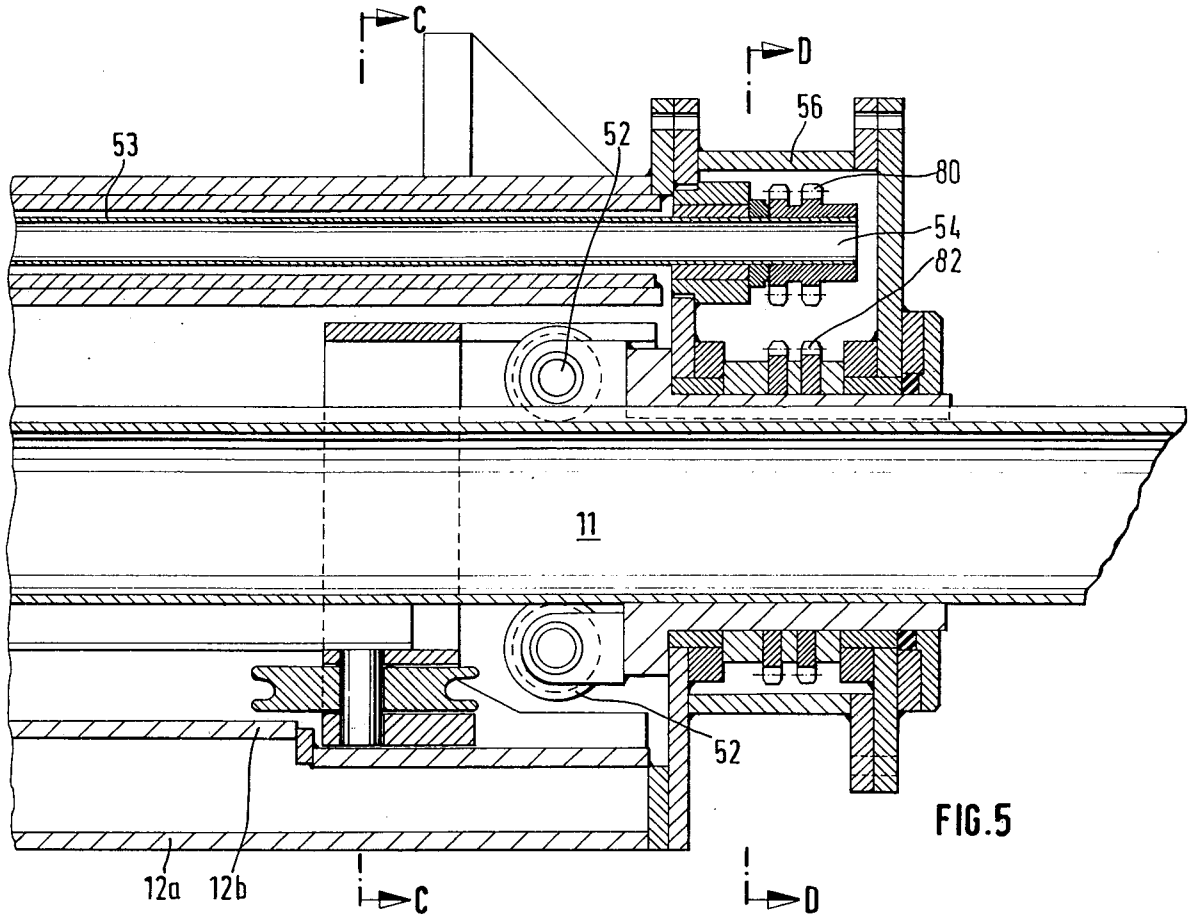
FIG. 5 is an enlarged view of the front of the primary lance shown in FIG. 4.
Figure 6:
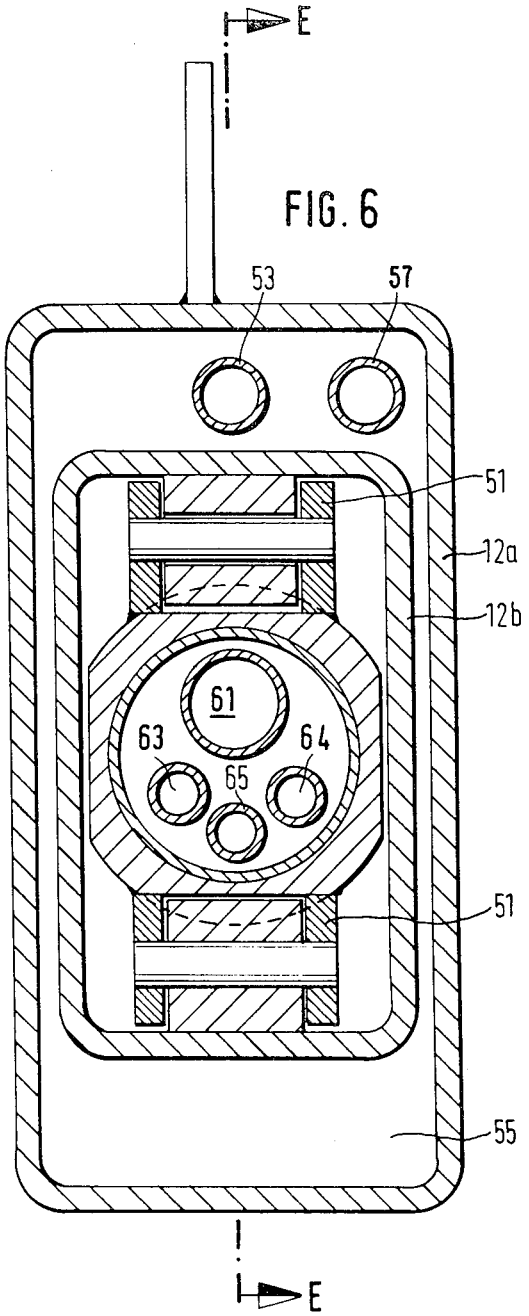
FIGS. 6 and 7 are respectively sections on A-A and B-B of FIG. 4.
Figure 7:
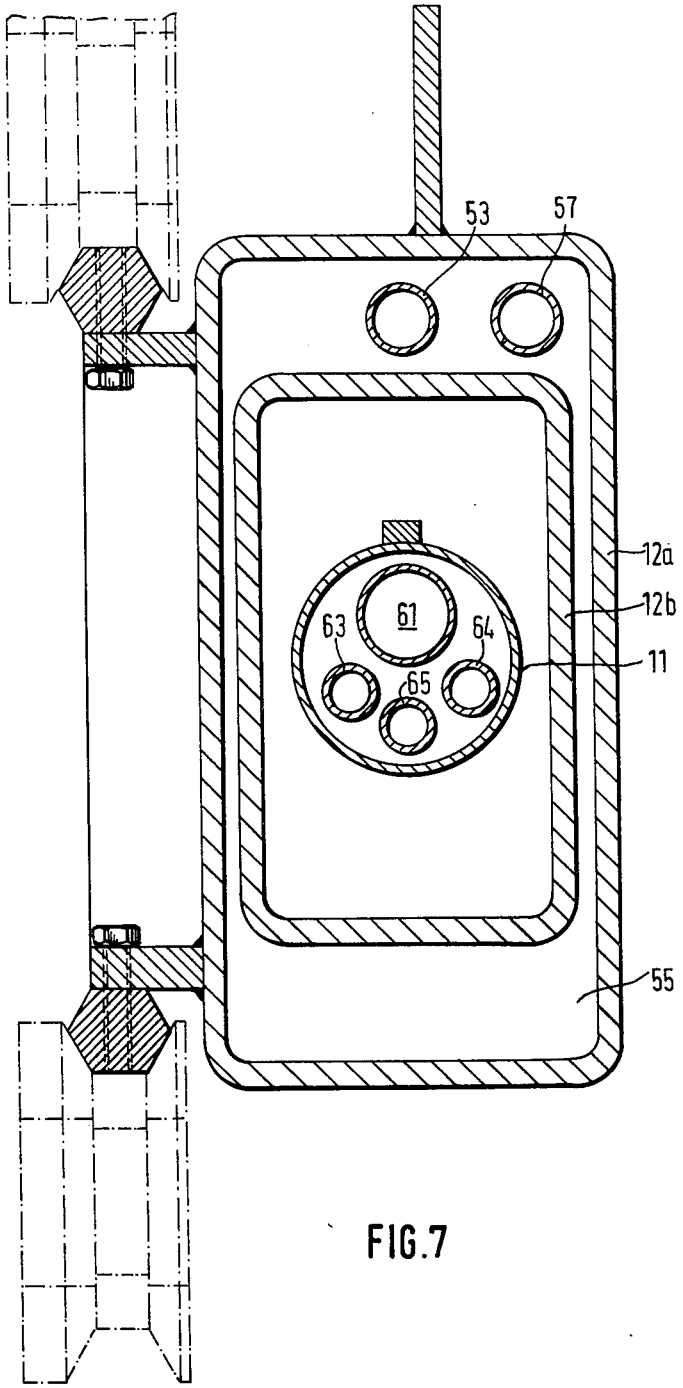
Figure 8:
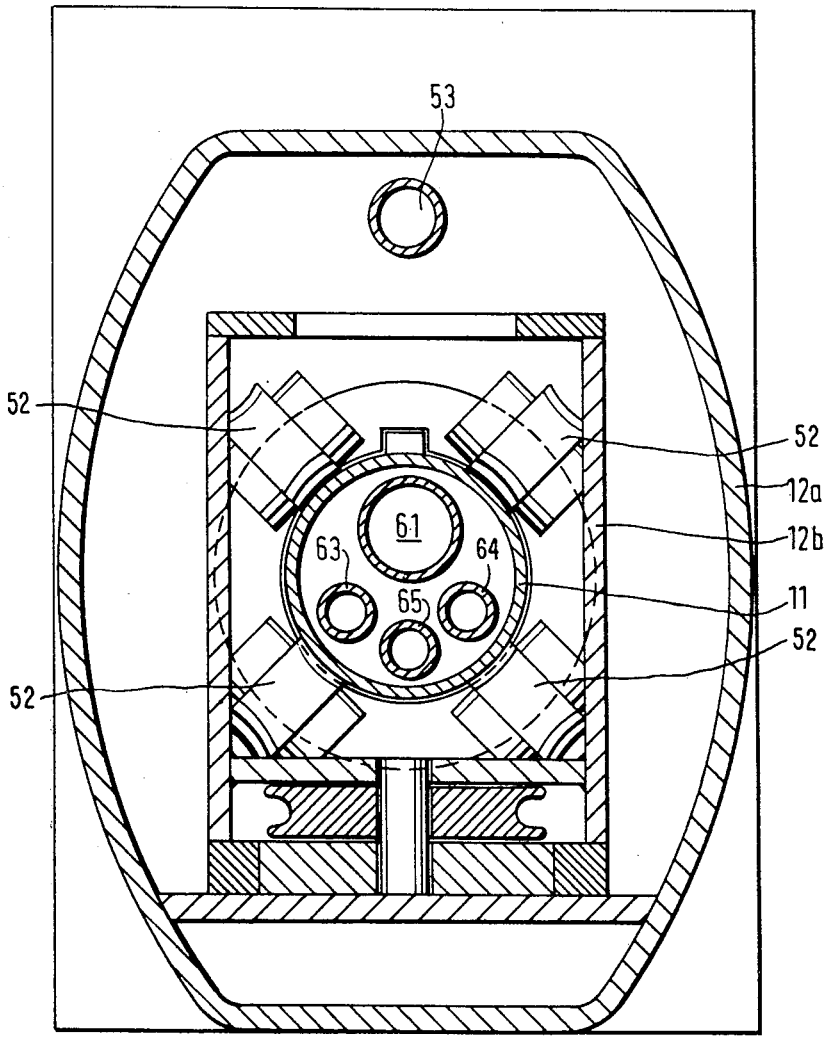
FIGS. 8 and 9 are respectively sections on the lines C-C and D-D of FIG. 5.

The normal working position of the apparatus is that shown in FIGS. 2 and 3, that is to say in which the lance carrier 13 finds itself approximately at right angles to the longitudinal axis of the supporting vehicle.

The pivoting column 17 allows the orientation of the lance carrier 13 to be varied between its operational position and the folded position permitting displacement of the vehicle on the working platform 7 and also permits direction of the lance when it is introduced into the converter.

The two parts 15*a* and 15*b* of the scissors comprise an articulation joint 21 permitting the angle of opening of the scissors under the influence of the jack 23 pivotally connected between the points 25 and 26 respectively provided on the parts 15*a* and 15*b* of the scissors.

A second jack 27 connected between the pivot points 29 and 30 respectively provided on the part 15*a* of the scissors and the lance carrier 13 permits the angular orientation of the lance carrier to be varied with respect to the said part 15*a*.

The lance is formed by at least two telescopic elements 11 and 12 in which circulates a cooling fluid which is preferably water.

The control of the different elements of the telescopic lance (elements 11 and 12) is obtained by a system of cable and chain (not shown) the outward movement of the primary lance automatically taking with it the outward movement or return of the secondary lance.

On the lance carrier 13 there is mounted a control cabin 39 which is located as near as possible to the longitudinal axis of the lance carrier 13 and of the lance 11 in such a way that the operator can follow the movement of this.

The movement of the lance carrier 13 and of the cabin 39 with which it is rigid is illustrated between raised position shown in full lines in FIG. 2 and a lowered positon shown in broken lines in the same figure.

The primary lance is formed by a tube with double walls 12*a* and 12*b* (FIGS. 4 to 9).

In the space between the walls 12*a* and 12*b* are received on the one hand a bush 53 for an operating axle for rotating the secondary lance 11 and a conduit 57 for leading the cooling fluid towards the end of the primary lance, the cooling fluid returning to the carrying apparatus in the space 55 formed by the double walls.

In the secondary lance 11 there is provided a conduit 61 for the passage of the refractory material, two conduits 63 and 64 of a circuit for the entry and discharge of a fluid for cooling the lance and a conduit 65 for feeding water or other additive to the projecting nozzle.

Figure 9:
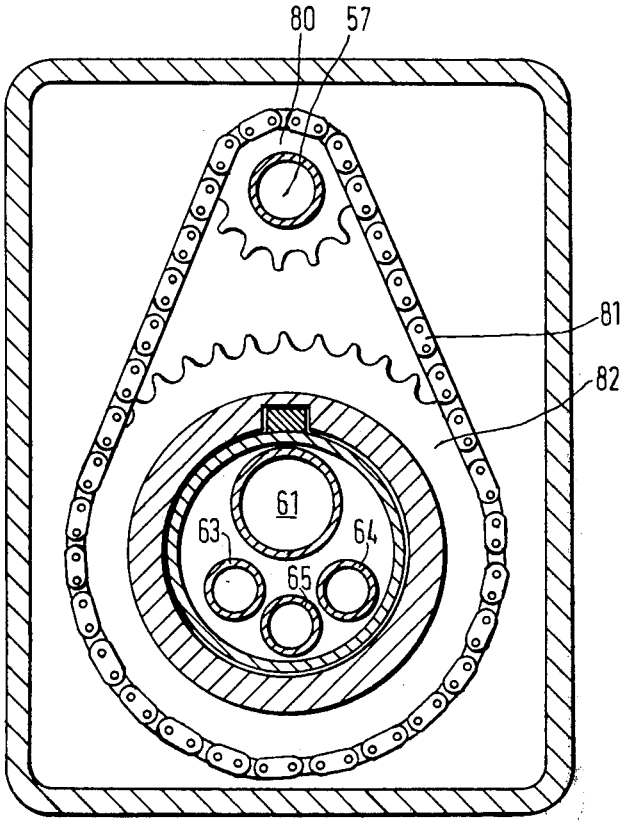

A housing 56 at the end of the primary lance 12 contains a shaft 54 located in the sheath 53 rigid with a pinion 80 which drives my means of a double chain 81 a pinion 82 keyed on the secondary lance 11 (FIG. 9). Thus, rotation of shaft 54 causes secondary lance 11 to be rotated relative to the primary lance 12. The secondary lance 11 may incorporate deflecting nozzles for directing the refractory material to any point of the converter into which the nozzle is introduced.

The secondary lance 11 may be extended outwardly from the primary lance 12 as stated previously. Rollers 51 (FIGS. 4 and 6) and 52 (FIGS. 5 and 8) act to guide and support the secondary lance 11 within the primary lance 12. The rollers 51, 52 are also formed in such a manner that the rotation of the secondary lance 11, mentioned previously, within the primary lance 12 by the action of the pinions 80, 81 and the chain 82 is facilitated.

The technical process obtained by the present invention lies in the possibility of reaching, by simple control of a scissors, parts of a converter which are difficult of access.

By combining this scissors arrangement with a transmission for rotating the lance equipped at its extremity with deflecting nozzles for the projected material it becomes possible in practice to reach any location whatever of the converter, angularly as well as vertically.

The advantage of the scissor arrangement with the joints described is to permit not only any angular disposition but equally a variation in height limited only by the total travel of the jacks, which has not been foreseen by the apparatus in the state of the art. For this reason the apparatus in accordance with the invention can be used for gunning any surfaces whatsoever and in particular special furnaces and elements in steelworks.

A complementary advantage follows from the particular disposition of the control cabin because it is located substantially on the longitudinal axis of the lance carrier and of the lance which allows the operater to see at all times the movement of the lance and to follow the projection of the refractory material. He can therefore by simple actions modify the angle of the lance and direct the projection as he wants it.

Another advantage of the arrangement is its autonomous character which groups together the functions of movement of the apparatus on the ground, the control of the positioning of the lance, and the projection of the refractory material. The power can be provided from any outside totally independent source for an autonomous motor on the apparatus and/or by a simple electric cable connected to the system.

The apparatus can be mounted equally well on rails as on roads. It can also be connected to an external source of compressed air or carry a self-contained compressor for pneumatic projection of the refractory material.

Although there has been described embodiments of the invention which are specially preferred it should be understood that variation and modification are available to one skilled in the art while remaining within the field of the invention.

I claim:

1. A mobile gunning apparatus for projecting refractory material in hard to reach locations during relining or repairing a converter or similar metallurgical furnace tiltable about a generally horizontal axis for discharging, and relining or repairing the discharge opening thereof, without excessively tilting the furnace or discharging its slag or damaging its discharge opening, comprising a base mounted on wheels, a scissors-like, upright, support member having an upper arm pivotably connected to a lower arm for relative movement about a generally horizontal first pivot, a first adjusting means operatively connecting said arms for causing relative movement of said arms about the first pivot for opening and closing the arms in scissors-like fashion, one of said arms being pivotably connected to the base for relative movement about a generally vertical second pivot spaced from said first pivot connection between said arms, a lance carrier operatively connected to the other of said arms for relative movement about a generally horizontal third pivot, a second adjusting means operatively connecting said lance carrier and other arm for causing relative movement of said other arm and lance carrier about said third pivot, a lance comprising a primary lance and a secondary lance having relative movement in a path generally perpendicular to said first pivot, said primary lance being slidably mounted on said lance carrier for relative movement thereto, said secondary lance having a nozzle on its distal end and being telescopically mounted in the primary lance for relative movement thereto and for relative movement through said discharge opening, in said furnace and generally perpendicular to the axis of each of said pivots, means for moving said secondary lance by endwise and rotatable relative movement relative to said primary lance, means on said base for preparing refractory material and operatively connected by a conduit to said nozzle for projecting said refractory material from the nozzle on the secondary lance, so that during gunning only the nozzle and a portion of the lance are in the discharge opening or inside the furnace while the remainder of the apparatus is located outside the furnace, and with the relative movements permitting relative pivoting about the generally vertical and horizontal axes, raising and lowering of the lance carrier and its lance relative to said base, and moving the secondary lance endwise and rotatably relative to the lance carrier and primary lance for directing refractory material from its nozzle with precision at any convenient angle or location within the furnace or its discharge opening without excessively tilting the furnace or discharging its slag or damaging its discharge opening.

2. A mobile gunning apparatus, as set forth in claim 1, further comprising a carrier for a single operator having means for controlling the positioning of said nozzle, said carrier being rigidly carried by and on one side of said lance carrier and constructed and arranged to position the operator on one side of the lance carrier with the operator's line of sight positioned along the longitudinal working line of action of the secondary lance for looking through the discharge opening of the furnace, for accurately positioning the nozzle and secondary lance within the furnace and its discharge opening, and for directing refractory material from the nozzle with precision at any convenient angle and/or location within the furnace or its discharge opening without excessively tilting the furnace or discharging its slag or damaging its discharge opening.

3. A mobile gunning apparatus, as set forth in claim 1 or 2, further comprising adequate protection against heat from within said furnace, including said carrier being a cabin for protecting said single operator from heat from the furnace, and conduit means for circulating cooling fluid through both said secondary lance and said primary lance for cooling said lance, comprising said primary lance including a double walled jacket for receiving said cooling fluid.

* * * * *